US005489163A

United States Patent [19]

Thomann

[11] Patent Number: 5,489,163

[45] Date of Patent: Feb. 6, 1996

[54] DRAINAGE CHANNEL

[75] Inventor: Roland Thomann, Langnau, Switzerland

[73] Assignee: ABT, Inc., Troutman, N.C.

[21] Appl. No.: 119,695

[22] Filed: Sep. 10, 1993

[30] Foreign Application Priority Data

Sep. 10, 1992 [CH] Switzerland ..... 1852/92

[51] Int. Cl.[6] ..... E02B 5/00

[52] U.S. Cl. ..... 405/118; 405/126

[58] Field of Search ..... 405/36, 118–124, 405/126

[56] References Cited

U.S. PATENT DOCUMENTS

| | | | |
|---|---|---|---|
| 3,611,731 | 10/1971 | Edmondson | 405/120 |
| 4,257,716 | 3/1981 | Woodrow | 405/118 |
| 4,630,966 | 12/1986 | Karbstein | 405/118 |
| 4,954,015 | 9/1990 | McGowan | 405/119 X |
| 5,000,621 | 3/1991 | Beamer | 405/118 X |

FOREIGN PATENT DOCUMENTS

| | | |
|---|---|---|
| 618703 | 9/1991 | Australia . |
| 167384 | 1/1986 | European Pat. Off. . |
| 2341706 | 9/1977 | France . |
| 2625757 | 7/1989 | France . |
| 8715791 | 3/1988 | Germany . |
| 9211253 | 12/1992 | Germany . |
| 588597 | 6/1977 | Switzerland . |

*Primary Examiner*—John A. Ricci
*Attorney, Agent, or Firm*—Bell, Seltzer, Park & Gibson

[57] ABSTRACT

The invention provides a drainage channel preferably formed from a sheet material, such as stainless steel. The channel has a flat bottom and upwardly extending sidewalls that form an acute angle with the bottom. A pair of shoulders extend outwardly from upper portions of the sidewalls for receiving a grate. Upper edge walls extend upwardly from outer portions of each shoulder. The exterior width of the channel at its bottom is less than the interior width or the channel between the upper edge walls, but greater than the interior channel width between the upper ends of the sidewalls. Consequently, the drainage channel can be mechanically anchored in concrete without requiring use of additional anchoring elements, and is also stackable.

16 Claims, 1 Drawing Sheet

DRAINAGE CHANNEL

BACKGROUND OF THE INVENTION

A drainage trench or channel of polyester concrete is known, for example, from European Patent No. 112,187. This channel has proved to be very reliable, particularly for applications such as roads, airports or airfields. However, facilities housing food processing operations such as, for example, dairies or meat plants are typically moist, and it is therefore preferable for hygienic reasons to form the channel from a substantially non-porous material such as chrome steel or other stainless steel, instead of polyester concrete.

SUMMARY OF THE INVENTION

In accordance with the invention, a drainage channel is provided which allows hygienically satisfactory operation and cleaning. Drainage channels according to the present invention include a substantially flat bottom wall adjacent upwardly extending sidewalls. The transverse width of the channel at bottom portions thereof, i.e., between lower portions of the sidewalls, is greater than at upper portions thereof, i.e., between upper portions of the sidewalls. A pair of shoulders for supporting a grate or similar channel covering element, extend outwardly from the top portions of the sidewalls. Preferably, edge walls extend upwardly from the outer edge of each shoulder to further define the grate receiving top portion of the channel. Advantageously the channel is formed from a non-porous material such as stainless steel.

The design and construction of the channel of the present invention not only provides for hygienically satisfactory operation and cleaning, but also allows simplified manufacture of the channel from a single sheet of material by forming, preferably bending, an elongate sheet to the desired shape. The drainage channel of the present invention provides several additional advantages, including the formfitting and mechanical locking of the drainage channel into a surrounding casting material such as concrete, without requiring use of additional anchoring elements.

Because of its shape and the positioning of the grate receiving shoulders, when the drainage channel of the invention is anchored into a permanent location by a surrounding load supporting material such as hardened concrete, forces applied to a grate covering the open top of the channel are transmitted by the channel shoulders directly into the surrounding load supporting material. Consequently, the drainage channel may be fabricated with thin walls to thereby minimize the use of raw materials and the weight of the channel. Manufacturing and transportation costs are thus decreased. In addition, the design of the drainage channel also allows a number of channel segments to be stacked so as to simplify transportation and storage. Further, the design of the drainage channel decreases the amount of water or other cleaning liquid that may be splashed out of the channel when it is cleaned by spraying with a hose or during a similar cleaning operation.

In one preferred embodiment of the invention a channel coupling member is provided at one end of the channel for joining to another longitudinally adjacent channel. Preferably the coupling member is shaped and sized in conformance with a lower portion of the channel exterior for engaging a longitudinal end portion of the channel in formfitting engagement. The shaped coupling member extends longitudinally beyond the channel end for formfitting engagement with the exterior of a longitudinally adjacent second channel at one end thereof. This allows individual channels of the invention to be joined into a continuous channel of desired length in a simple and formfitting manner. The preferred coupling member also effects alignment of the individual channels both longitudinally and in height.

BRIEF DESCRIPTION OF THE DRAWINGS

In the drawings which form a portion of the original disclosure of the invention.

DETAILED DESCRIPTION OF THE PREFERRED EMBODIMENTS

Figure 1:
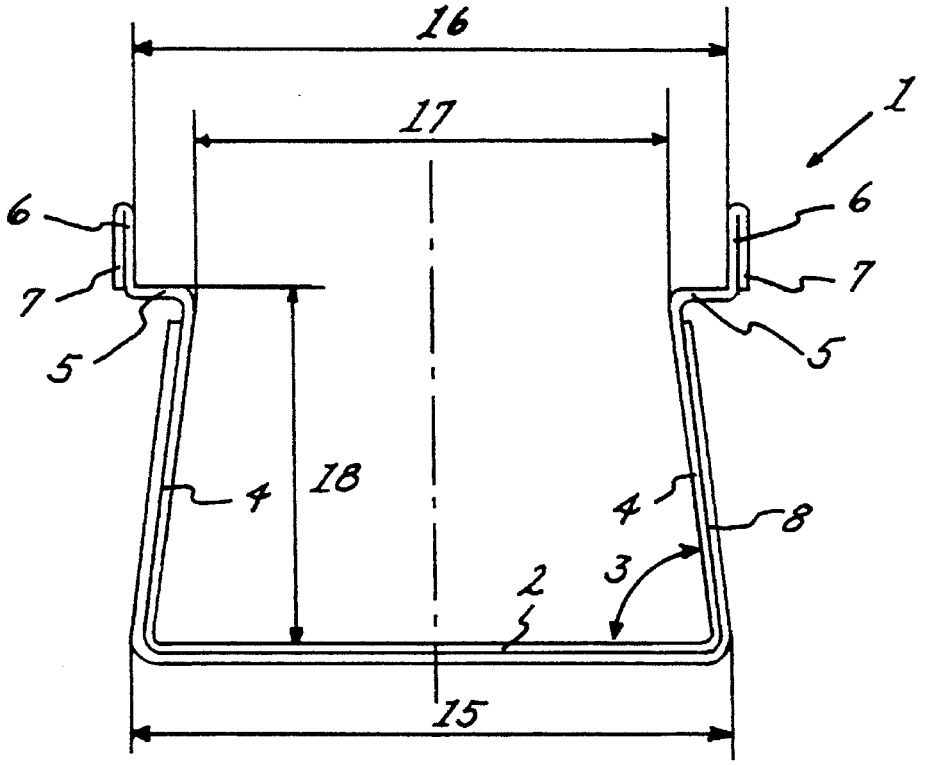
FIG. 1 is a cross-sectional view of a preferred drainage channel of the invention.

In the following detailed description, preferred embodiments of the invention are described in detail. Although the invention is described with reference to specific preferred embodiments, including those illustrated in the drawings, it will be understood that the invention is not intended to be so limited. To the contrary, the invention includes numerous alternatives, modifications and equivalents as will become apparent from the consideration of the foregoing discussion and the following detailed description.

A channel 1, as illustrated in FIG. 1, is advantageously formed from a bent, stainless steel sheet. The channel 1 includes a substantially flat bottom 2 and two substantially flat sidewalls 4 forming identical acute angles 3 with the bottom 2. Joined to each sidewall 4 and extending outwardly therefrom is a flat shoulder 5 for receiving a channel covering grate. Edge walls 6 extend vertically upward from outer edges of shoulders 5. A second edge wall 7 provides for flanging and reinforcing of the edge wall 6, and increases the effective wall thickness thereof. The edge wall 7 is bent 180° from the upwardly extending edge wall 6 and also prevents the formation of a sharp edge along the upper edges of the open top of the channel.

Figure 2:
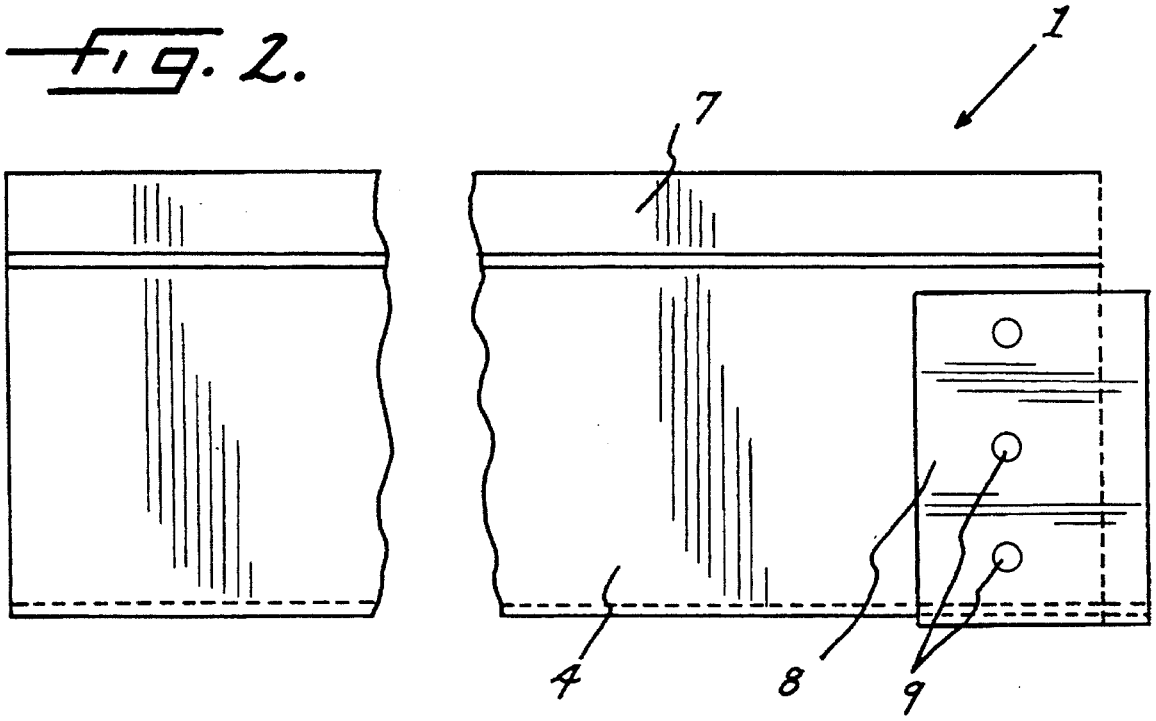
FIG. 2 is a side view of the channel of FIG. 1.

One side of a preferred channel coupling member 8 is shown in FIG. 2. The coupling member 8, is also advantageously formed from a folded metal sheet and is shaped and sized in profile to conform to the bottom 2 and the sidewalls 4 of one end of the channel in formfitting engagement as best shown in FIG. 1. The coupling member 8 is advantageously fixedly attached to the bottom and sidewalls at one end of the channel 1, by conventional means, such as by welding points 9, and projects beyond a front end of the channel 1. The portion of the coupling member 8 projecting beyond the end of the channel is also shaped and sized in profile to receive, in formfitting engagement, an end portion of an additional channel 1. In an alternative embodiment, the coupling member 8 may be formed so as to slip over and be retained upon the channel 1 as a result of tensile forces applied by the coupling member to the exterior of the channel 1.

As illustrated in FIG. 1, the exterior transverse width 15 of the channel 1 at a location adjacent its bottom 2 is less than the interior width 16 of the channel at the top thereof, i.e., between the upper edge walls 6. However the exterior width 15 at the bottom of the channel is greater than the interior width 17 of the channel at the upper portion of sidewalls 4. This allows each individual channel 1 to support the bottom 2 of another channel stacked onto the upper surfaces of its shoulders 5. In addition the opposed upper edge walls 6 of lower channels serve to maintain alignment of the upper channels stacked thereon. Thus transportation and storage of the channels can be accomplished with increased stability and decreased use of space.

The design of the channel 1 also provides for a formfitting anchoring of the channel 1 in concrete or a like hardenable material. In this regard, it will be seen that a hardenable material poured around the exterior of the channel sidewalls 4 will serve to lock the channel 1 into a fixed position because hardened material along the outside of the angled sidewalls will prevent upward movement of the channel 1 while the outwardly extending shoulders 5 prevent any downward movement of the channel. Also, as indicated previously, after hardening of a load bearing material poured around the channel, the shape of the channel minimizes or eliminates the load transferred to the channel walls as a result of forces applied to a grate covering the open top of the channel. Accordingly, the channels can readily be fabricated from materials of minimal wall thickness and/or strength.

Advantageously the channels of the invention can be provided with differing depths or heights while still being adapted for stacking. This is accomplished by fabricating groups of channels 1 such that the sidewalls 4 differ in height between groups of channels, but otherwise the dimensions 15, 16, 17, are substantially identical between groups. Consequently, the depth of the drainage channel may be adapted to a plurality of local conditions while the stackability of such channels 1 having different heights may be maintained. In this instance, angle 3 varies depending on height 18 of the sidewalls 4. It will be apparent that the width of the channels 1 may also be varied. However, channels which have the same width, but differing heights may still be stacked onto each other.

As indicated previously, in the preferred embodiments, the channels are fabricated from a stainless steel sheet material. However, depending on the application, the material forming the channel 1 may also be galvanized steel preferably in sheet form, a plastic material such as fiber-reinforced synthetic resin, also preferably in sheet form, or another nonporous material, in sheet form.

The channels of the invention can advantageously be used or fabricated in combination with outflow components, such as, for example, a lateral discharge conduit, a conduit adapted for discharge downwardly into a pipe and having a lateral bend. Preferably, such outflow components have a unilaterally closed wall. In addition, collecting elements, which are likewise unilaterally closed, may also be offered.

The invention has been described in considerable detail with reference to its preferred embodiments. However it will be apparent that the invention is susceptible to various changes and modifications without departure from the spirit and scope of the invention as described in the foregoing specification and drawings and defined in the appended claims.

That which is claimed is:

1. A drainage channel comprising:

a substantially flat bottom wall;

a pair of sidewalls extending upwardly from said bottom wall;

a pair of shoulders, each extending outwardly from an upper end of a respective sidewall in substantially parallel relationship to said bottom wall for receiving a grate; and a pair of upper edge walls, each extending upwardly from an outer edge of one shoulder;

the exterior width of the channel adjacent the bottom wall thereof being less than the interior width of the channel between the upper edge walls and greater than the interior width of the channel between the upper ends of said sidewalls.

2. A drainage channel as recited in claim 1 wherein each of said sidewalls is substantially flat and form an acute angle with said bottom wall.

3. A drainage channel as recited in claim 1 wherein each upper edge wall comprises a second edge wall extending downwardly therefrom at an angle of substantially 180°.

4. A drainage channel as recited in claim 3 wherein said channel is formed from a non-porous sheet material.

5. A drainage channel as recited in claim 4 wherein said non-porous sheet material is sheet metal.

6. A drainage channel as recited in claim 5 wherein said sheet metal is stainless steel.

7. A drainage channel as recited in claim 4 wherein said non-porous sheet material is fiber-reinforced plastic.

8. A drainage channel as recited in claim 1 further comprising a coupling member attached to the exterior of one longitudinal end of said channel and having a profile adapted for formfitting engagement of said bottom wall and sidewalls of said channel and extending from said end of said channel for coupling to a second drainage channel.

9. A drainage channel as recited in claim 8 wherein said coupling member is formed from a non-porous sheet material.

10. A drainage channel as recited in claim 9 wherein said non-porous sheet material is sheet metal.

11. A drainage channel as recited in claim 10 wherein said sheet metal is stainless steel.

12. A drainage channel as recited in claim 9 wherein said non-porous sheet material is fiber-reinforced plastic.

13. A drainage channel as recited in claim 1 wherein said channel is formed from a non-porous sheet material.

14. A drainage channel as recited in claim 13 wherein said non-porous sheet material is sheet metal.

15. A drainage channel as recited in claim 14 wherein said sheet metal is stainless steel.

16. A drainage channel as recited in claim 13 wherein said non-porous sheet material is fiber-reinforced plastic.

* * * * *